US007341440B2

(12) United States Patent
Kim et al.

(10) Patent No.: US 7,341,440 B2
(45) Date of Patent: Mar. 11, 2008

(54) SCROLL COMPRESSOR

(75) Inventors: Cheol Hwan Kim, Seoul (KR); Dong Koo Shin, Anyang-si (KR); In Hwe Koo, Seongnam-si (KR); Myungkyun K. Kiem, Incheon-si (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 10/939,581

(22) Filed: Sep. 14, 2004

(65) Prior Publication Data

US 2005/0058565 A1 Mar. 17, 2005

(30) Foreign Application Priority Data

Sep. 15, 2003 (KR) ..... 10-2003-0063672

(51) Int. Cl.
*F01C 1/02* (2006.01)

(52) U.S. Cl. ..... 418/55.3; 418/55.5; 418/57

(58) Field of Classification Search ..... 418/55.3, 418/55.5, 57, 152

See application file for complete search history.

(56) References Cited

U.S. PATENT DOCUMENTS 4,810,176 A * 3/1989 Suefuji et al. ..... 418/55.3
5,085,565 A * 2/1992 Barito ..... 418/55.4
5,413,469 A * 5/1995 Nakajima et al. ..... 418/55.1
6,106,252 A * 8/2000 Yamanaka et al. ..... 418/55.3
6,146,119 A * 11/2000 Bush et al. ..... 418/55.4
6,287,099 B1 9/2001 Chang, II et al.
6,341,945 B1 * 1/2002 Hugenroth et al. ..... 417/214
6,389,837 B1 * 5/2002 Morozumi ..... 62/324.6
6,719,545 B2 * 4/2004 Iizuka ..... 418/55.3

FOREIGN PATENT DOCUMENTS

JP 2003-239875 8/2003

OTHER PUBLICATIONS

U.S. Appl. No. 10/832,300 to Shin et al., which was filed on Apr. 27, 2004.
U.S. Appl. No. 10/832,334 to Shin et al., which was filed on Apr. 27, 2004.
U.S. Appl. No. 10/832,379 to Shin et al., which was filed on Apr. 27, 2004.
English Language Abstract of JP 2003-239875.

* cited by examiner

*Primary Examiner*—Hoang Nguyen
(74) *Attorney, Agent, or Firm*—Greenblum & Bernstein, P.L.C.

(57) ABSTRACT

A scroll compressor includes an orbiting scroll having a compressor chamber in an upper portion thereof and a bypass passage formed through upper and lower ends of a body thereof, a fixed scroll that allows the orbiting scroll to orbit therein to compress a coolant, an Oldham ring on which the orbiting scroll is seated, the Oldham ring having an upper chamber formed on an upper surface thereof with predetermined width and depth and a lower chamber formed on a lower surface thereof with predetermined width and depth, and a main frame on which the Oldham ring is seated.

19 Claims, 6 Drawing Sheets

SCROLL COMPRESSOR

BACKGROUND OF THE INVENTION

1. Field of the Invention

The present invention relates to a scroll compressor, and more particularly, to a scroll compressor capable of reducing a frictional force between parts by adjusting high pressure generated during the compressing process by means of the orbiting movement of an orbiting scroll in the scroll compressor.

2. Description of the Related Art

Generally, a scroll compressor is operated for compressing by means of relative movement of a fixed scroll and an orbiting scroll, and widely used in the fields of room air conditioners and automobile air conditioners owing to its advantageous characteristics such as high efficiency, low noise, small size and light weight.

The scroll compressor is classified into a low pressure scroll compressor and a high pressure scroll compressor according to the filling gas, namely whether an inhaling gas is filled in the casing or a discharging gas is filled therein, and the following description is based on the low pressure scroll compressor.

A scroll compressor generally includes a main frame, an Oldham ring seated on the upper surface of the main frame for linear movement, an orbiting scroll seated on the upper portion of the Oldham ring for orbiting movement, and a fixed scroll positioned at an upper portion of the orbiting scroll and fixed to the main frame. In addition, the fixed scroll has a fixed scroll wrap spirally twisted, and the orbiting scroll has an orbiting scroll wrap spirally twisted and formed on the upper surface thereof. In more detail, the fixed scroll wrap and the orbiting scroll wrap form a compressor chamber, and the fluid received in the compressor chamber is compressed by means of movement of the orbiting scroll.

FIG. 1 is a sectional view showing the compressing process accomplished in a general scroll compressor of the related art.

Referring to FIG. 1, the conventional scroll compressor includes a fixed scroll wrap 81 formed on the fixed scroll, an orbiting scroll wrap 71 formed on the upper surface of the orbiting scroll and inserted into the fixed scroll wrap 81 to form a compressor chamber P, and a discharge port 9 formed at the center of the orbiting scroll wrap 71 and the fixed scroll wrap 81 so that a compressed fluid may be discharged through it.

To describe the compressing process by the above configuration, the fluid collected in the compressor chamber P of a relatively larger volume formed in the outer portion of the scroll wraps 71 and 81 is moved toward the center by means of the orbiting movement of the orbiting scroll wrap 71. As the fluid moves toward the center, its volume is gradually decreased, thereby increasing the pressure. In addition, the pressure of the fluid is maximum at the center of the scroll wraps 71 and 81, and the fluid gathered at the center is discharged through the discharge port.

The compressor which is operated as above for compressing is already disclosed in U.S. Pat. No. 6,287,099, filed by the same applicant of this application.

The conventional scroll compressor may have a tip seal on the uppermost surface of the orbiting scroll wrap in order to prevent the fluid from being partially leaked outward when the pressure of the fluid is excessively increased.

However, in case of the conventional low pressure scroll compressor to which the above configuration is applied, the tip seal may be melted by high temperature in the compressor chamber P, and the coolant gas may be leaked out of the compressor chamber P.

In addition, if a pressure in the compressor chamber P is excessively increased, the excessive pressure is applied to the Oldham ring seated between the orbiting scroll and the main frame. That is to say, if an excessive pressure is applied to the Oldham ring, the excessive pressure causes excessive frictions between the lower end of the orbiting scroll and the upper end of the Oldham ring and between the lower end of the Oldham ring and the upper end of the main frame, thereby increasing the pressure loss caused by friction.

SUMMARY OF THE INVENTION

Accordingly, the present invention is directed to a scroll compressor that substantially obviates one or more problems due to limitations and disadvantages of the related art.

An object of the invention is to provide a scroll compressor having an improved Oldham ring that can discharge a middle pressure coolant from a compressor chamber, and decreasing a frictional force applied to the Oldham ring by using the discharged middle pressure gas.

Another object of the present invention is to provide a scroll compressor that can prevent a high pressure gas in the compressor chamber from leaking out by rising an Oldham ring and an orbiting scroll with the use of the discharged middle pressure gas so that the orbiting scroll is closely adhered to a fixed scroll.

A further object of the present invention is to provide a scroll compressor in which an excessive frictional force is not generated between a lower surface of the Oldham ring and a thrust surface of the main frame by means of the pressure in the compressor chamber.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a scroll compressor, which includes: an orbiting scroll having a compressor chamber in an upper portion thereof and a bypass passage formed through upper and lower ends of a body thereof; a fixed scroll for allowing the orbiting scroll to orbit therein for compressing a coolant; an Oldham ring on which the orbiting scroll is seated, the Oldham ring having an upper chamber formed on an upper surface thereof with predetermined width and depth and a lower chamber formed on a lower surface thereof with predetermined width and depth; and a main frame on which the Oldham ring is seated.

Preferably, the upper chamber is connected to a lower end of the bypass passage.

Also preferably, the compressor chamber is communicated with an upper end of the bypass passage.

A lower end of the bypass passage is preferably positioned between an inner circumference and an outer circumference of the upper chamber while the orbiting scroll is orbiting.

The upper and/or lower chamber may have a strap shape with a predetermined diameter.

Preferably, a width of the lower chamber is at least equal to or larger than a width of the upper chamber.

The upper and/or lower chamber may include at least one sealing member seated on an inner side thereof.

The scroll compressor may further include a communication hole with a predetermined diameter so that the upper chamber is communicated with the lower chamber.

Preferably, the Oldham ring has at least one key protruded on a lower surface thereof, and the main frame has at least one key groove so that the key is seated therein.

In another aspect of the present invention, there is provided a scroll compressor, which includes: a driving shaft having an oil channel formed therein; a main frame for supporting the driving shaft, the main frame having key grooves oppositely formed on an upper surface thereof with predetermined depth and width; a fixed scroll fixedly combined to the main frame; an orbiting scroll seated on an upper portion of the main frame, the orbiting scroll having at least one bypass passage in one side thereof so that a compressed coolant is partially discharged through the bypass passage; and an Oldham ring seated between the orbiting scroll and the main frame, the Oldham ring having a back pressure chamber for storing a part of the discharged compressed coolant and a protrusion protruded in a predetermined height at upper and/or lower surfaces of a body thereof.

In still another aspect of the invention, there is also provided a scroll compressor, which includes a main frame having a thrust surface on an upper portion thereof; an Oldham ring linearly reciprocating with a lower surface thereof being in contact with the thrust surface, the Oldham ring having a back pressure adjusting unit at upper and/or lower surface thereof so that a coolant gas is partially flowed therein; and a compressing member seated on an upper surface of the Oldham ring and forming a compressor chamber for compressing a coolant.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, specific embodiments of the present invention will be described with reference to the accompanying drawings. However, the spirit of the invention is not limited to the embodiments, but other embodiments may be easily proposed within the scope of the invention or other retrograde inventions by adding, changing or deleting other components.

Figure 1:
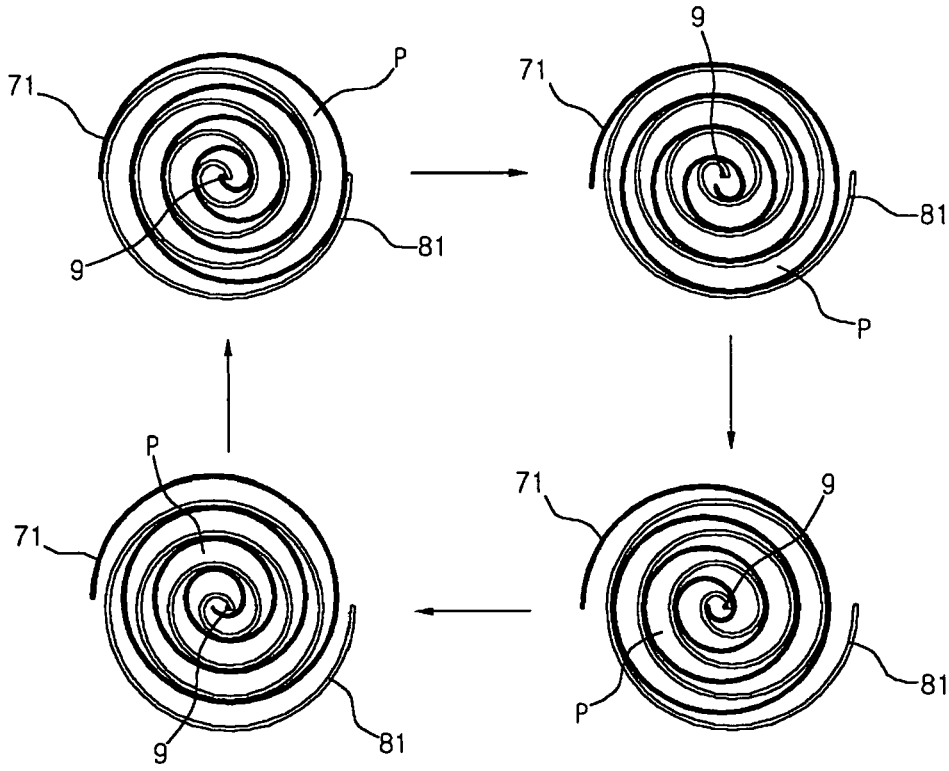
Fig 1. (Related Art)
FIG. 1 is a sectional view showing a general scroll compressor according to the related art.
Figure 2:
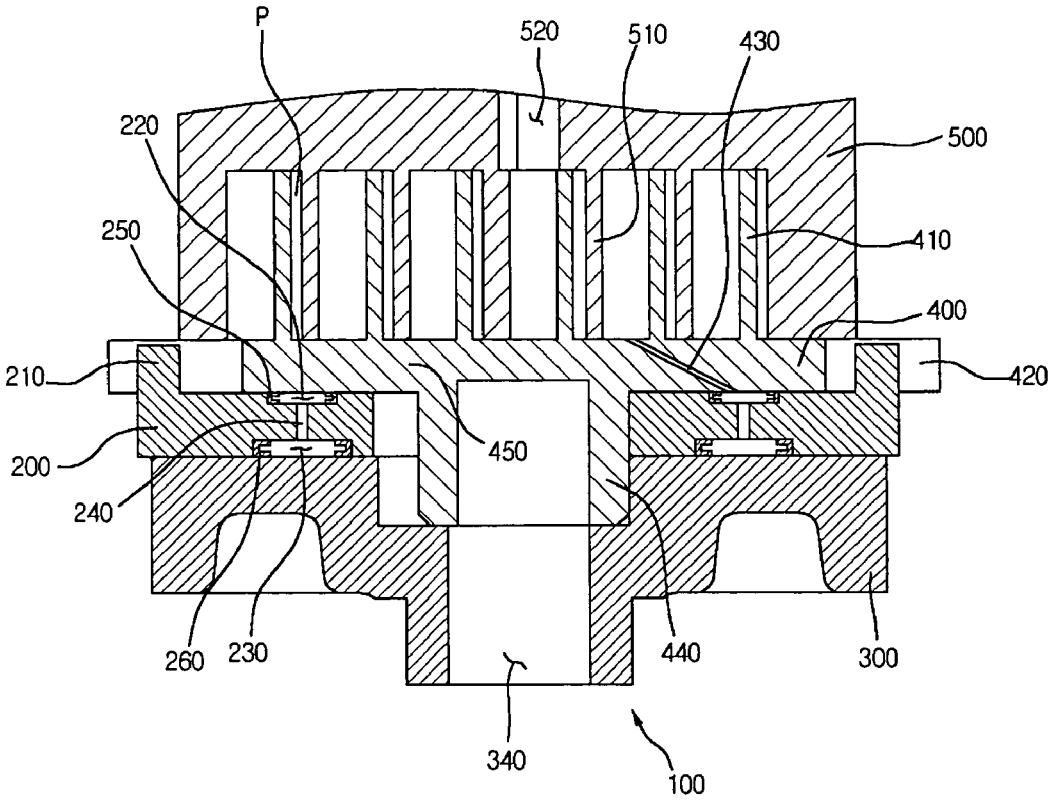
FIG. 2 is an enlarged sectional view showing main components of a scroll compressor according to the present invention.

FIG. 2 is an enlarged sectional view showing main components of a scroll compressor according to the present invention.

Referring to FIG. 2, the scroll compressor 100 of the present invention includes a main frame 300 for supporting an upper end of a driving shaft, an Oldham ring 200 seated on the upper portion of the main frame to linearly reciprocate, an orbiting scroll 400 seated on the upper portion of the Oldham ring to compress a coolant with orbiting, and a fixed scroll 500 fixed to the main frame 300 and forming a compressor chamber P therein together with the orbiting scroll.

In more detail, the main frame 300 includes a driving shaft hole 340 at its center so that the driving shaft passes through it, a thrust surface (described later) contacted with the lower surface of the Oldham ring 200, and a lower key groove (described later) depressed toward the center as much as a predetermined length from the outer side of the thrust surface with predetermined depth and width.

In addition, the Oldham ring 200 includes at least two upper keys 210 protruded on the upper surface thereof as much as a predetermined height and combined with the lower end of the orbiting scroll 400. Moreover, a lower key (described later) is also formed therein so as to be seated on the lower key groove formed in the main frame 300.

In addition, an upper chamber 220 with a predetermined depth is formed at a position spaced apart from the center in a diameter direction as much as a predetermined distance. In more detail, the upper chamber 220 forms a circular strap with predetermined depth and width. In addition, a lower chamber 230 with predetermined height and width is formed upward from a lower bottom of the Oldham ring 200. Here, a high pressure coolant gas stored in the compressor chamber P is received in spaces of the upper and lower chambers 220 and 230. In addition, a communication groove 240 is formed vertically so as to connect the upper and lower chambers 220 and 230. Thus, the coolant gas gathered in the upper chamber 220 is moved to the lower chamber 230 along the communication groove 240.

Meanwhile, the orbiting scroll 400 seated on the upper end of the Oldham ring 200 includes a body 450 having a disc shape, and an orbiting scroll wrap 410 spirally curved on the upper end of the body with a predetermined height. In addition, at one side of the lower end of the orbiting scroll 400, there are formed an upper key groove 420 on which the upper key protruded on the upper end of the Oldham ring 200 is inserted and seated, and an orbiting axis 440 having a circular rod shape which is extended in a vertical direction from the bottom surface of the body 450 as much as a predetermined length and has a hollow therein.

In addition, a bypass passage 430 is formed to pass through upper and lower portions of the body 450 with being inclined at a predetermined angle. In more detail, the bypass passage 430 is formed to communicate with the upper chamber 220 formed in the upper portion of the Oldham ring 200. Thus, the high pressure coolant gas existing in the compressor chamber P is moved down along the bypass passage 430 to the upper chamber 220.

Meanwhile, the fixed scroll 500 seated on the upper end of the orbiting scroll 400 is hollow and includes a fixed scroll wrap 510 spirally curved and having a predetermined length from the inner upper surface thereof. In more detail, the fixed scroll wrap 510 is seated between the orbiting scroll wraps 410 so as to form a compressor chamber P as the orbiting scroll 400 is orbiting. In addition, the volume of the compressor chamber P is decreased toward the center of the orbiting scroll 400, so the coolant received in the compressor chamber P is compressed at high pressure. Moreover, a discharge port 520 is formed at the center of the fixed scroll 500 so that the coolant compressed at high pressure is discharged to a discharge chamber (not shown).

Now, the compressing operation occurring at the scroll compressor 100 is described.

First, a coolant is introduced into the scroll compressor, and the introduced coolant is input to the compressor chamber P. In more detail, the coolant is received in the compressor chamber of a relatively large volume, formed at the edge of the scroll wraps 410 and 510. In addition, as the orbiting scroll 400 orbits, the volume of the compressor chamber is decreased and moves to the center along the spiral of the scroll wraps 410 and 510. And then, the coolant compressed at high pressure with moving to the center is transferred to the discharge chamber through the discharge port 520.

Meanwhile, the edge of the fixed scroll 500 is combined to the main frame 300 by means of at least one combination member. In addition, the orbiting scroll 400 is linearly reciprocated on the upper surface of the Oldham ring 200. Moreover, the Oldham ring 200 is linearly reciprocated on the upper surface of the main frame 300.

Here, the direction that the orbiting scroll 400 is linearly reciprocated is crossed at a predetermined angle with the direction that the Oldham ring 200 is linearly reciprocated. Resultantly, the orbiting scroll 400 is orbited on the basis of the main frame 300.

Figure 3:
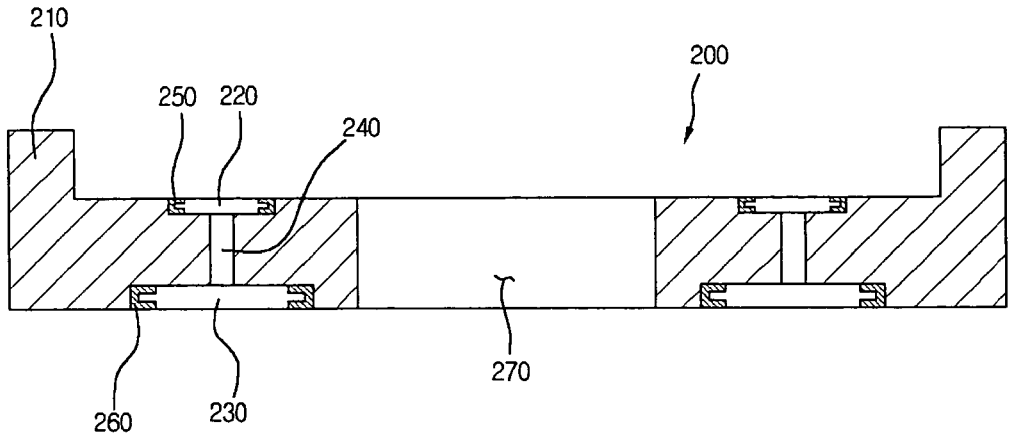
FIG. 3 is a side sectional view showing an Oldham ring of the scroll compressor according to the present invention.

FIG. 3 is a side sectional view showing the Oldham ring of the scroll compressor according to the present invention.

Referring to FIG. 3, the Oldham ring 200 of the scroll compressor according to the present invention has an upper key 210 protruded on the upper surface thereof as much as a predetermined height.

In more detail, there are two upper keys 210 at positions faced with each other, and the upper keys 210 are inserted into the upper key grooves 420 formed in the lower surface of the orbiting scroll 400 as mentioned above. In addition, an orbiting axis hole 270 having a predetermined diameter is formed at the center of the Oldham ring 200, and the orbiting axis 440 passes through the orbiting axis hole 270.

In addition, the upper chamber 220 with predetermined width and depth is formed at a position spaced apart as much as a predetermined distance from the orbiting axis hole 270. In more detail, the upper chamber 220 forms a circular strap along the circumferential shape of the Oldham ring 200. In addition, an upper sealing member 250 is mounted to the inner circumferential edge of the upper chamber 220. The upper sealing member 250 plays a role of preventing a middle pressure coolant introduced into the upper chamber 220 from being leaked through the upper end of the Oldham ring 200.

Here, due to the pressure of the middle-pressure coolant collected in the upper chamber 230, the orbiting scroll 400 is raised slightly from the upper surface of the Oldham ring 200. It reduces the friction generated between the orbiting scroll 400 and the Oldham ring 200. Furthermore, if the orbiting scroll 400 is raised, the upper surface of the orbiting scroll wrap 410 is closely adhered to the upper portion of the fixed scroll 500. Thus, the oil cannot be leaked through the upper end of the orbiting scroll wrap 410.

In addition to that, in the present invention, there is no need to attach a separate sealing member to the upper end of the orbiting scroll wrap 410 like the related art, so the conventional problem that the sealing member is melt by high pressure and high temperature in the compressor chamber P is eliminated.

In addition, the lower chamber 230 with predetermined width and depth is also provided to the lower surface of the Oldham ring 200. A lower sealing member 260 is mounted to the inner circumferential edge of the lower chamber 230 in a strap shape. Thus, the middle pressure coolant received in the lower chamber 230 is not leaked out between the Oldham ring 200 and the mainframe 300.

In more detail, the sealing members 250 and 260 attached to the upper and lower chambers 220 and 230 are made of resin material which endures high temperature, and their sections form a "⊂" shape.

In addition, the communication hole 240 for connection of the upper and lower chambers 220 and 230 is formed so that the coolant in the upper chamber 220 may move to the lower chamber 230. Moreover, due to the pressure possessed by the middle pressure coolant collected in the lower chamber 230, the Oldham ring 200 is raised slightly from the main frame 300. Thus, the friction generated between the Oldham ring 200 and the main frame 300 is reduced.

Meanwhile, the width of the lower chamber 230 is greater than the width of the upper chamber 220. It is because the pressure applied to the lower chamber 230 is greater than the pressure applied to the Oldham ring 200. This is described later in more detail.

Figure 4:
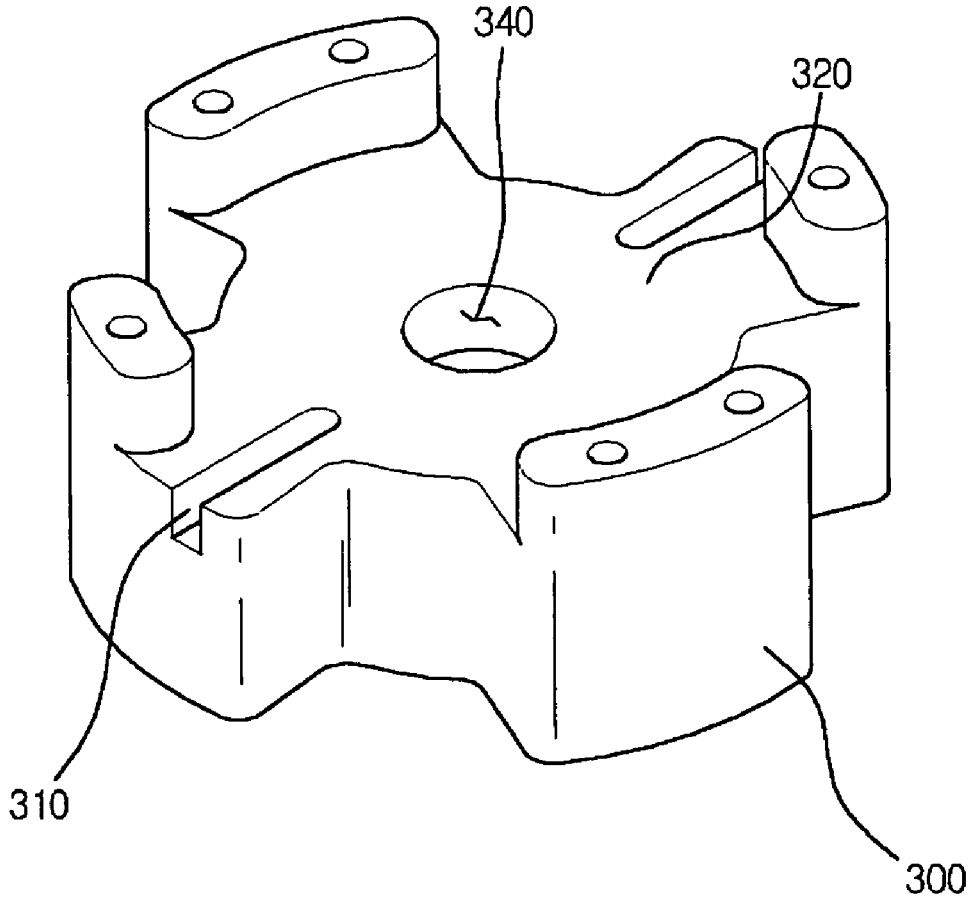
FIG. 4 is a perspective view showing a main frame of the scroll compressor according to the present invention.

FIG. 4 is a perspective view showing the main frame of the scroll compressor according to the spirit of the present invention.

Referring to FIG. 4, the main frame 300 of the scroll compressor according to the present invention includes the driving shaft hole 340 at its center for a driving shaft (not shown) to pass through, and the thrust surface 320 surface-contacted with the lower surface of the Oldham ring.

In addition, a lower key groove 310 with predetermined width and depth is formed on the thrust surface 320 so that the lower key formed on the lower end of the Oldham ring 200 may be inserted therein.

Now, the process of supplying oil to the main frame 300 is described.

First, the lubricating oil is moved upward along an oil channel formed in the driving shaft, and then accumulated from the end of the driving shaft into a space interposed by the thrust surface 320. And then, the oil accumulated in the space flows along the thrust surface 320. Then, by means of the reciprocating movement of the Oldham ring 200 surface-contacted with the thrust surface 320, the oil is dispersed uniformly on the whole thrust surface 320. A part of the oil dispersed along the thrust surface 320 is flowed to the lower key groove 310. Thus, the lubricating oil reduces a frictional heat generated between the Oldham ring and the thrust surface 320.

Figure 5:
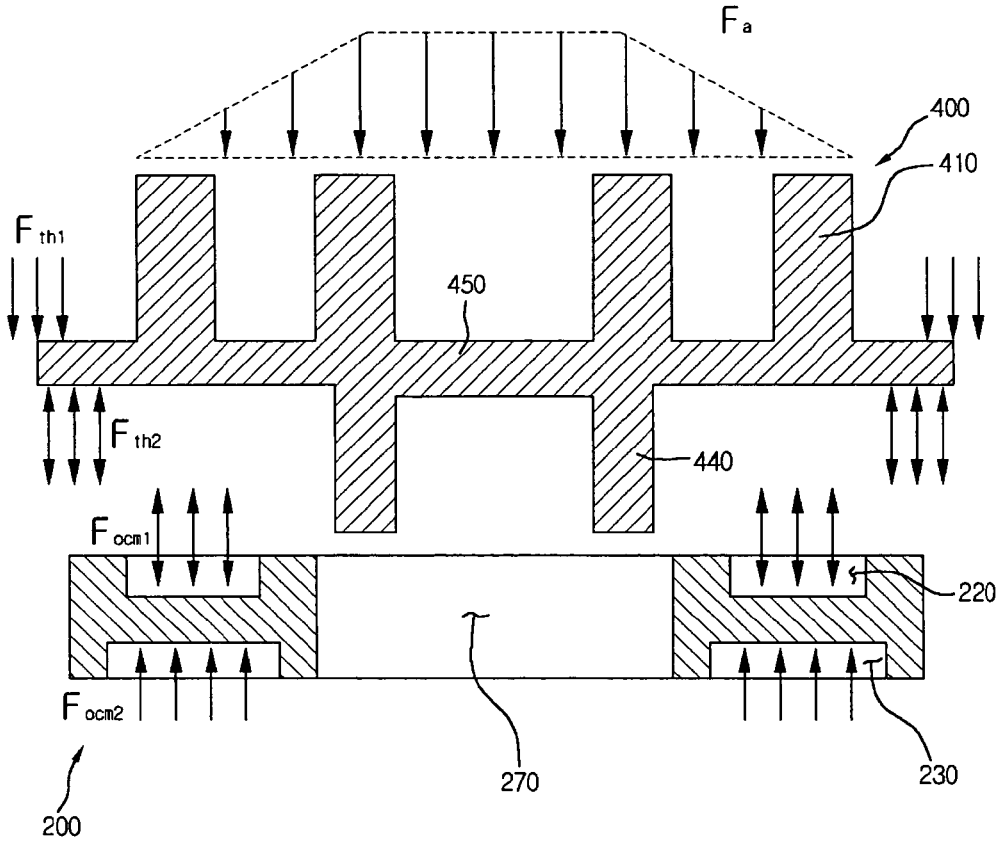
FIG. 5 shows pressure distribution applied to an orbiting scroll and the Oldham ring in the scroll compressor according to the present invention.

FIG. 5 shows pressure distribution applied to the orbiting scroll and the Oldham ring in the scroll compressor according to the spirit of the present invention.

Referring to FIG. 5, a total coolant gas force $F_a$ is offset by a middle pressure coolant gas back pressure $F_{ocm2}$ to make the equilibrium of force. In more detail, the coolant gas force $F_a$ means a force applied to the whole orbiting scroll 400 in the compressor chamber P. In addition, the middle pressure coolant gas back pressure $F_{ocm2}$ means a back pressure of the coolant gas discharged from the upper chamber 220 to the lower chamber 230 through the communication hole 240 formed in the Oldham ring 200. At this time, the Oldham ring 200 and the orbiting scroll 400 are raised up to a predetermined height until the whole coolant gas force $F_a$ is in equilibrium with the coolant gas back pressure $F_{ocm2}$. In addition, if the coolant gas force $F_a$ applied to the whole orbiting scroll 400 is in equilibrium with the back pressure $F_{ocm2}$ of the coolant gas discharged to the lower chamber 230, the upward movement of the Oldham ring 200 and the orbiting scroll 400 is stopped.

In addition, an adhering force between the orbiting scroll 400 and the fixed scroll 500 is changed according to the difference between the back pressure $F_{ocm2}$ generated in the lower chamber 230 and the whole coolant gas force $F_a$ applied to the whole orbiting scroll 400. As a result, a thrust repulsive force $F_{th1}$ is exerted on the surface where the orbiting scroll 400 and the fixed scroll 500 are contacted.

Meanwhile, the thrust repulsive force $F_{th1}$ may adjust an amount of the coolant gas discharged to the lower chamber 230 through the bypass passage 430 formed through the body 450 of the orbiting scroll 400, thereby being capable of controlling the back pressure $F_{ocm2}$ applied to the lower chamber 230. That is to say, by controlling the back pressure $F_{ocm2}$ applied to the lower chamber 230, a magnitude of the thrust repulsive force $F_{th1}+F_{th2}$ applied to the orbiting scroll 400 may be controlled.

Here, the force applied to the orbiting scroll 400, the force applied to the Oldham ring 200, and the thrust repulsive force applied to both ends of the orbiting scroll 400 may be expressed by a mathematical equation as follows.

1. Force applied to the Orbiting Scroll $$F_{th2}+F_{ocm1}-F_a-F_{th1}=0$$

$$F_{th1}=F_{th2}+F_{ocm1}-F_a$$

2. Force applied to the Oldham Ring $$F_{ocm2}-F_{th2}-F_{ocm1}=0$$

$$F_{th2}=F_{ocm2}-F_{ocm1}$$

3. Thrust Repulsive Force $$\therefore F_{th1}=F_{ocm2}-F_a$$

$$F_{th2}=F_{ocm2}-F_{ocm1}$$

Figure 6:
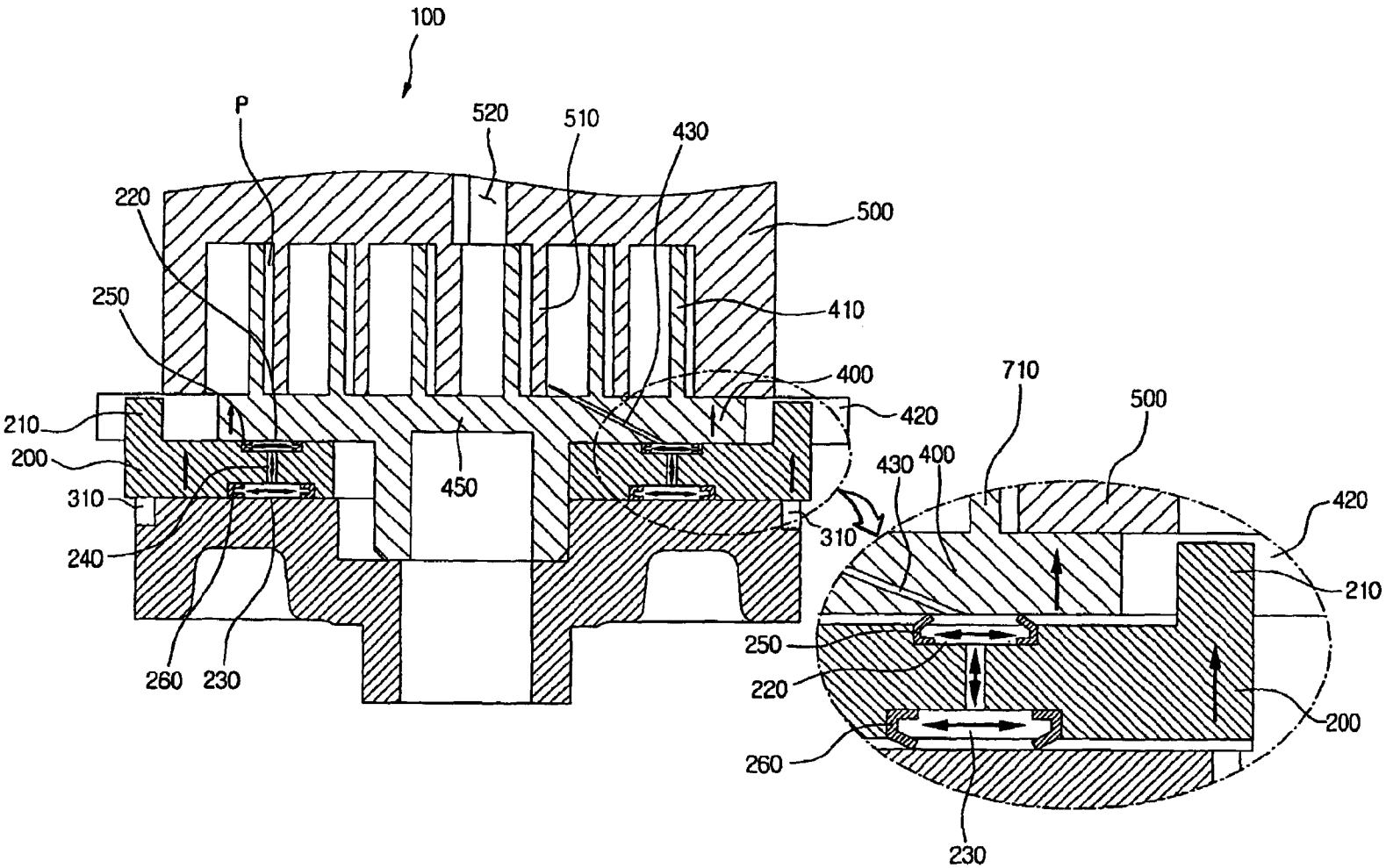
FIG. 6 is a sectional view showing coolant gas flows in a compressor chamber and forces exerted by the coolant gas in the scroll compressor according to the present invention.

FIG. 6 is a sectional view showing coolant gas flows in the compressor chamber and forces exerted by the coolant gas in the scroll compressor according to the present invention.

Referring to FIG. 6, the scroll compressor of the present invention is formed to decrease the loss caused by the frictional force between the orbiting scroll 400 and the Oldham ring 200 and between the Oldham ring 200 and the main frame 300 by discharging a part of the high pressure coolant gas received in the compressor chamber P through the bypass passage 430.

In more detail, if the middle pressure coolant discharged through the bypass passage 430 is collected in the upper chamber 220, the pressure in the upper chamber 220 is increased. In addition, by means of the pressure, the coolant presses the upper sealing member 250 seated on the inner circumferential edge of the upper chamber 220.

Meanwhile, since the upper sealing member 250 is made of material enduring high temperature with flexibility, the upper sealing member 250 leaves space by the pressure. As shown in the figure, the upper end of the upper sealing member 250 is upwardly inclined at a predetermined angle by the pressure of the upper chamber 220, thereby leaving space. As a result, the orbiting scroll 400 seated on the upper end of the Oldham ring 200 is slightly raised by means of the pushing force of the upper sealing member 250. As the upper end of the upper sealing member 250 leaves space, the upper sealing member 250 keeps contacting with the lower surface of the orbiting scroll 400. Thus, the upper sealing member 250 prevents the coolant gas in the upper chamber 220 from being leaked through a gap.

To the contrary, the lower chamber 230 is open at its lower end. Thus, the lower end of the lower sealing member 260 mounted to the inner circumferential edge leaves space with being inclined downward, and its effect is identical to the upper sealing member 250. That is to say, since the lower sealing member 260 pushes the thrust surface 320 of the main frame 300, the pushing force makes the Oldham ring 200 be slightly raised from the thrust surface 320. It reduces the frictional force generated between the Oldham ring 200 and the thrust surface 320. In addition, the oil flowing along the thrust surface 320 may also be smoothly moved.

Meanwhile, as mentioned above, the lower chamber 230 has a width wider than the upper chamber 220. It is because the pressure supported by the lower chamber 230 should be greater than the pressure supported by the upper chamber 220.

In addition, the lower end of the bypass passage 430 should be always communicated with the upper chamber 220 while the orbiting scroll 400 is orbiting. Thus, the orbiting diameter of the bypass passage 430 is preferably ranged between the inner and outer diameters of the upper chamber 220.

Moreover, the upper end of the bypass passage 430 is communicated with the compressor chamber P through the upper surface of the orbiting scroll 400. Here, the inner pressure of the compressor chamber P is gradually increased from an outside of the orbiting scroll 400 to the center. Thus, as the upper end of the bypass passage 430 is formed at a position nearer to the center of the orbiting scroll 400, the back pressure of the discharged coolant gas is increased.

The scroll compressor according to the present invention forms a plurality of back pressure pockets and a plurality of feeding holes in the Oldham ring, thereby smoothly supplying oil between the thrust surface of the upper frame and the lower surface of the orbiting scroll though an overload is applied to the compressor. Thus, the scroll compressor of the present invention gives an effect of reducing or eliminating abrasion of parts, frictional heat, noise and vibration, which are caused by the friction.

In addition, since the oil is rapidly transferred to the key portion of the Oldham ring, it is possible that the Oldham ring is guided to linearly reciprocate more smoothly, thereby decreasing noise and vibration and preventing the oil from being scattered.

The present disclosure relates to subject matter contained in Korean Patent Application No. 10-2003-63672, filed on Sep. 15, 2003, the contents of which are herein expressly incorporated by reference in its entirety.

What is claimed is:

1. A scroll compressor comprising:

an orbiting scroll having a compressor chamber in an upper portion thereof and a bypass passage formed through upper and lower ends of a body thereof;

a fixed scroll that allows the orbiting scroll to orbit therein to compress a coolant;

an Oldham ring on which the orbiting scroll is seated, the Oldham ring having an upper chamber formed on one surface thereof with predetermined width and depth and a lower chamber formed on another surface thereof with predetermined width and depth;

a main frame on which the Oldham ring is seated; and at least one sealing member seated on an inner side of the upper and/or lower chamber to prevent the compressed coolant and oil from leaking out of the chamber, wherein the Oldham ring and the orbiting scroll are respectively raised slightly from a thrust surface and the Oldham ring by a pressure in the back pressure chamber.

2. The scroll compressor according to claim 1, wherein the upper chamber is connected to a lower end of the bypass passage.

3. The scroll compressor according to claim 1, wherein the compressor chamber is communicated with an upper end of the bypass passage.

4. The scroll compressor according to claim 1, wherein a lower end of the bypass passage is positioned between an inner circumference and an outer circumference of the upper chamber while the orbiting scroll is orbiting.

5. The scroll compressor according to claim 1, wherein the upper and/or lower chamber forms a strap shape with a predetermined diameter.

6. The scroll compressor according to claim 1, wherein a width of the lower chamber is at least equal to or larger than a width of the upper chamber.

7. The scroll compressor according to claim 1, further comprising a communication hole with a predetermined diameter so that the upper chamber is communicated with the lower chamber.

8. The scroll compressor according to claim 1, wherein the Oldham ring has at least one key protruded on a lower surface thereof, and the main frame has at least one key groove so that the key is seated therein.

9. A scroll compressor comprising:

a driving shaft having an oil channel fonned therein;

a main frame that supports the driving shaft, the main frame having key grooves oppositely formed on an upper surface thereof with predetermined depth and width;

a fixed scroll fixedly combined to the main frame;

an orbiting scroll seated on an upper portion of the main frame, the orbiting scroll having at least one bypass passage in one side thereof so that a compressed coolant is partially discharged through the bypass passage and key grooves oppositely formed on a lower surface thereof with predetermined depth and width;

an Oldham ring seated between the orbiting scroll and the main frame, the Oldham ring having a back pressure chamber that is formed in opposite surfaces of the Oldham ring to store a part of the discharged compressed coolant and a plurality of protrusions protruded in a predetermined height at upper and/or lower surfaces of a body thereof, the protrusions being seated in the key grooves, and the back pressure chamber having a round shaped strip with predetermined width and depth, and a sealing member mounted on an inner circumference of the back pressure chamber; and at least one sealing member seated on an inner side of the back pressure chamber, wherein the bypassed coolant is trapped in the back pressure chamber by the sealing member so that the bypassed coolant is cut off from leaking out to the key grooves.

10. The scroll compressor according to claim 9, wherein the main frame has a driving shaft hole at a center thereof so that the driving shaft passes through the hole; and the key groove is curved from an outer circumference of a thrust surface toward a center of the main frame as much as a predetermined distance.

11. The scroll compressor according to claim 9, wherein at least one of the Oldham ring and the orbiting scroll is raised slightly from the main frame or the Oldham ring by a widening movement of the sealing member.

12. The scroll compressor according to claim 9, wherein the sealing member is substantially "." shaped.

13. The scroll compressor according to claim 9, wherein the back pressure chamber comprises:

an upper back pressure chamber formed in an upper side of the Oldham ring;

a lower back pressure chamber formed in a lower side of the Oldham ring; and a communication hole for communication the upper back pressure chamber with the lower back pressure chamber.

14. The scroll compressor according to claim 9, wherein the protrusions comprise:

at least one upper key protruded on the upper surface as much as a predetermined height and inserted into a lower portion of the orbiting scroll; and at least one lower key protruded downward on a lower surface as much as a predetermined height and inserted into the main frame.

15. The scroll compressor according to claim 9, wherein the sealing member has flexibility and is made of resin capable of enduring high temperature.

16. A scroll compressor comprising:

a main frame having a thrust surface on an upper portion thereof;

an Oldham ring linearly reciprocating with a lower surface thereof being in contact with the thrust surface, the Oldham ring having a back pressure adjusting unit at upper and/or lower surface thereof so that a coolant gas is partially flowed therein, the back pressure adjusting unit having upper and lower back pressure adjusting units respectively formed on opposite surfaces of the Oldham ring with predetermined widths;

a compressing member seated on an upper surface of the Oldham ring and forming a compressor chamber to compress a coolant; and sealing members transformably seated on an inner side of the upper and lower back pressure adjusting unit, wherein the sealing members are widen by the back pressure in the back pressure adjusting unit to slightly lift the orbiting scroll and the Oldham ring at a state that the ends of the sealing members closely contact the orbiting scroll and the Oldham ring respectively, and to prevent the coolant in the back pressure adjusting unit from leaking out.

17. The scroll compressor according to claim 16, wherein the lower back pressure adjusting unit has a width wider than a width of the upper back pressure adjusting unit.

18. The scroll compressor according to claim 17, further comprising at least one communication hole having predetermined diameter and length so as to communicate the upper back pressure adjusting unit with the lower back pressure adjusting unit.

19. The scroll compressor according to claim 16, further comprising at least one communication hole that communicates the back pressure adjusting unit with the compressor chamber.

* * * * *

UNITED STATES PATENT AND TRADEMARK OFFICE

CERTIFICATE OF CORRECTION

PATENT NO. : 7,341,440 B2
APPLICATION NO. : 10/939581
DATED : March 11, 2008
INVENTOR(S) : Kim et al.

It is certified that error appears in the above-identified patent and that said Letters Patent is hereby corrected as shown below:

At column 9, line 37, (claim 9, line 2) of the printed patent, "fonned" should be --formed--.

Signed and Sealed this

Sixteenth Day of September, 2008

JON W. DUDAS
*Director of the United States Patent and Trademark Office*